United States Patent [19]

Lavender

[11] Patent Number: 4,931,601

[45] Date of Patent: Jun. 5, 1990

[54] PRESSURE SWITCH HAVING INTERNAL VENT CHAMBER

[75] Inventor: William J. Lavender, Batavia, N.Y.

[73] Assignee: Eastman Kodak Company, Rochester, N.Y.

[21] Appl. No.: 313,790

[22] Filed: Feb. 23, 1989

[51] Int. Cl.[5] ..... H01H 35/34

[52] U.S. Cl. ..... 200/83 N; 200/5 A; 200/86 R; 200/306

[58] Field of Search ..... 307/118; 73/715, 717, 73/723; 200/5 A, 61.08, 83 R, 83 N, 83 W, 83 P, 81 R, 81.4, 86 R, 292, 302.1, 303, 306, 512, 515; 340/605, 611, 626, 665, 666; 251/331; 137/81.1; 235/200 R

[56] References Cited

U.S. PATENT DOCUMENTS

| | | | |
|---|---|---|---|
| 3,267,233 | 8/1966 | Basile et al. | 200/83 |
| 3,571,542 | 3/1971 | Madden | 251/331 |
| 3,917,917 | 11/1975 | Murata | 200/5 A |
| 4,066,851 | 1/1978 | White et al. | 200/5 A |
| 4,300,029 | 11/1981 | Maser | 200/83 N |
| 4,357,748 | 11/1982 | Branson | 200/83 N |
| 4,401,896 | 8/1983 | Fowler et al. | 307/118 |
| 4,409,443 | 10/1983 | Tyree et al. | 200/83 |
| 4,415,780 | 11/1983 | Dougherty | 200/515 |
| 4,454,768 | 6/1984 | Nansel | 200/81.9 R |
| 4,471,177 | 9/1984 | Doughty | 200/86 R |
| 4,496,812 | 1/1985 | Carley et al. | 200/159 |
| 4,543,457 | 9/1985 | Petersen et al. | 200/83 |
| 4,602,135 | 7/1986 | Phalen | 200/5 A |
| 4,608,465 | 8/1986 | Harada | 200/5 A |
| 4,694,126 | 9/1987 | Aiken, Jr. | 200/86 R |
| 4,716,262 | 12/1987 | Morse | 200/515 |

*Primary Examiner*—Gerald P. Tolin
*Attorney, Agent, or Firm*—John B. Turner

[57] ABSTRACT

Layers of a thin, electrically insulating material are bonded together to form a switch. The bottom layer of the switch has electrically conductive areas aligned with openings through a second layer. A third layer has a pattern of spaced lines of an electrical conductor positioned over the openings in the second layer. Fluid pressure applied to the bottom layer causes flexing of the bottom layer toward the third layer to bring the electrically conductive areas into contact with the pattern of conductive lines on the third layer, thereby closing the switch. A vent chamber in the second layer is pneumatically coupled to the openings in the second layer so that when the switch is closed air in the openings in the second layer can be vented to the vent chamber. The switch can be used to sense changes in fluid pressure in a water system, for example.

5 Claims, 2 Drawing Sheets

PRESSURE SWITCH HAVING INTERNAL VENT CHAMBER

BACKGROUND OF THE INVENTION

This invention relates to flexible, pressure activated switches and, in particular, to such a switch which is especially suitable for use in water or other fluid systems where pressure of the fluid activates the switch.

A pressure actuated switch is disclosed in commonly assigned U.S. patent application Ser. No. 176,538, filed Apr. 1, 1988 in the name of Henry L. West, and entitled "Fluid Pressure Switch Having Venting Means for Dispensing Back Pressure". The switch disclosed in such application comprises a plurality of layers bonded together to form a unitary switch. Two layers have electrically conductive elements thereon that are separated by another layer having openings aligned with the conductive elements so that pressure exerted against the switch surface deflects the layers to bring the electrically conductive elements into contact, thereby closing the switch. In order to avoid undesirable pressure increases in the openings when the switch is closed, the openings are vented through the top of the switch into large, closed chambers in a back-up plate so that closing the switch results in only nominal increase in the fluid pressure. In order to avoid leakage of water or other contaminants into the switch, the vent chamber in the back-up plate is surrounded by an O-ring which bears against the switch to seal the connection therebetween. The electrical conductors in the switch are either dome-shaped elements or comprise a strip of smooth stainless steel.

While the switch disclosed in the aforementioned application has generally worked satisfactorily, it appears that improvements can enhance the long term performance of the switch. For example, when used with a water or other liquid system, the liquid sometimes enters the vent openings even though they are firmly sealed by O-rings in the back-up plate. When this occurs, the switch is shorted out and fails. Also, the O-ring used between the switch and back-up plate, together with an O-ring on the opposite side of the switch, may deform the switch over a period of time, thus degrading its performance. Also, in one embodiment disclosed in the prior switch, the circular domes used for the electrical contacts contain sharp edges that can cut into the adjacent plastic material of the switch. This problem is avoided in another embodiment of the switch which uses a smooth strip of steel or other conductive material in place of the domes. However, even the steel strips can deteriorate over a period of time under extended exposure to water at pressures of, for example, 100 psi, until the trip pressure changes significantly. This problem is believed to be caused by creep of the adhesive between the steel layer and the adjacent plastic layers. Also, failure of the adhesive bonding the various layers together can result in leakage of water or other fluids into the switch to cause shorting or other defects in the switch.

SUMMARY OF THE INVENTION

Accordingly, it is an object of the present invention to eliminate the need to vent air outside the switch when the switch is actuated.

Another object of the invention is to provide an improved thin, flexible switch which eliminates the need for O-rings on both sides of the switch, and thus avoid excessive deformation of the switch that O-rings can produce.

A further object of the invention is to provide a thin, flexible switch which eliminates the need for electrical contacts in the form of domes, which are difficult to position and tend to cut into the adjacent plastic of the switch, or continuous sheets of metal which are difficult to bond to plastic layers due to creep in the adhesive used for bonding them.

The present invention relates to a switch adapted to be closed in response to pressure exerted on the switch. The switch comprises a plurality of thin layers of an electrically insulating material. A first one of the layers has on one surface an area of an electrically conductive material. A second one of the layers is in contact with the surface of the first layer, and has an opening therethrough aligned with the area of conductive material on the first layer. A third one of the layers is in contact with the second layer. The third layer has on the surface facing the second layer an area of an electrically conductive material aligned with the opening in the second layer. The layers are sufficiently flexible to enable the areas of electrically conductive material to be brought into engagement by pressure exerted on the switch. Means communicating with the opening defines an internal vent chamber for reducing air pressure build up in the opening when the areas of electrically conductive material are brought into contact. The vent chamber is fully enclosed within the layers.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
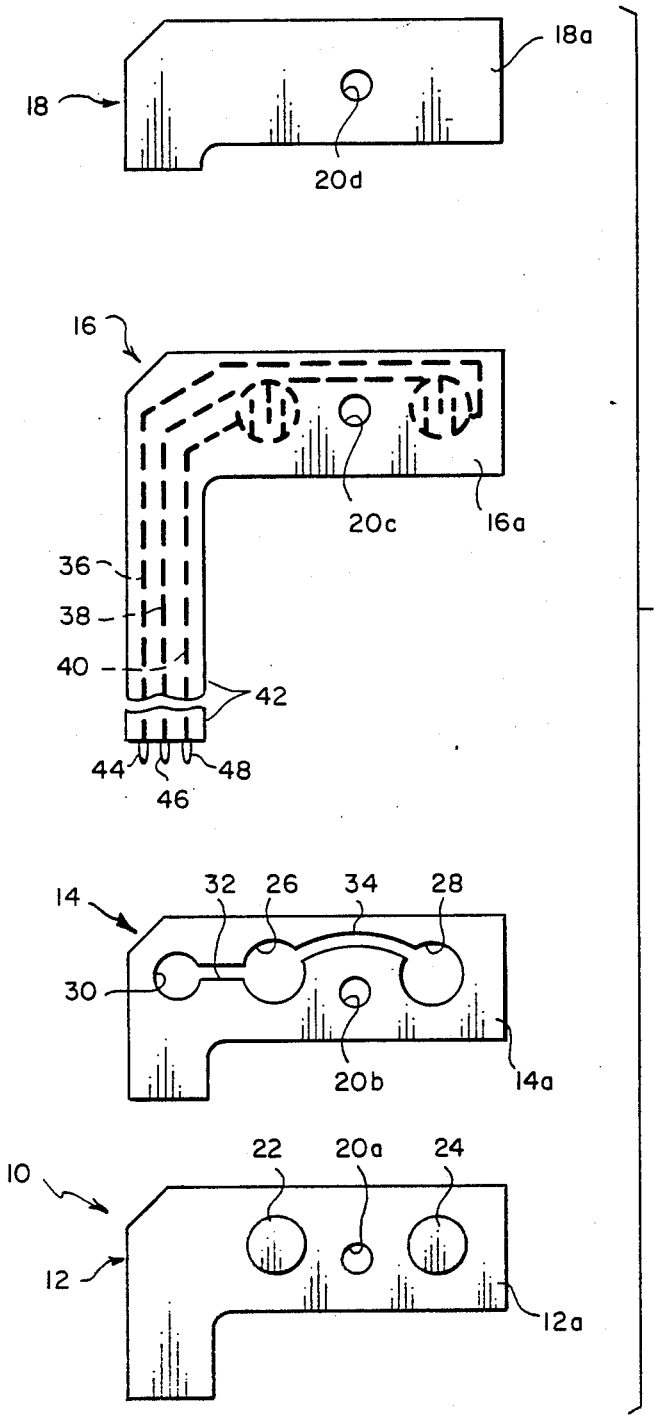
FIG. 1 is an exploded view of a preferred embodiment of the switch of the present invention.
Figure 2:
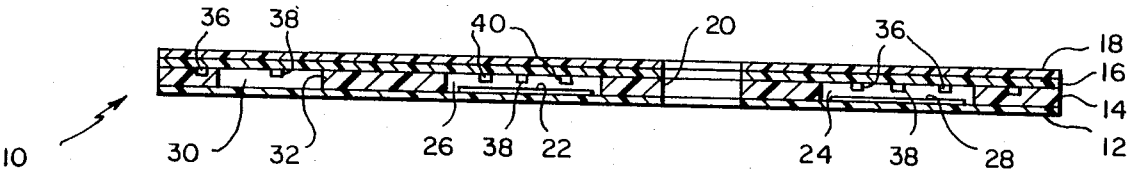
FIG. 2 is an enlarged transverse cross section through the switch showing the switch contacts in an open position.

Referring initially to FIGS. 1 and 2, a switch of the present invention is generally designated 10 and comprises four layers 12, 14, 16 and 18. Each of the layers 12–18 preferably is made of an electrically insulating material that is relatively thin and flexible so that the individual layers and the switch when assembled is flexible and responsive to fluid under pressure to operate the switch.

The layers have generally rectangular portions **12*a*, 14*a*, 16*a* and 18*a* of substantially the same size to provide a generally rectangular switch. Each layer also has a circular hole therethrough, as shown at 20*a*, 20*b*, 20*c*, and 20*d*, to provide a through hole 20, FIG. 2. As explained layer, hole 20** is used for mounting the switch on a housing or other piece of an apparatus.

Layer 12, shown at the bottom in FIGS. 1 and 2, comprises the side of the switch that receives the fluid pressure when the switch is used in a fluid system as explained later. Layer 12 has two spaced electrically conductive areas 22, 24 formed on the upper surface of the layer and generally equally spaced from the hole 20a. As illustrated in FIG. 1, the areas 22, 24 are circular in configuration and can be applied to the layer 1 by a printing technique using a substance sometimes referred to as "silver ink".

Layer 14 has a pair of circular openings 26, 28 that extend entirely through the layer. Openings 26, 28 comprise contact chambers and are aligned with the conductive areas 22, 24 on layer 12. Openings 26, 28 preferably are slightly larger in diameter than the areas 22, 24. In addition, layer 14 has a third opening 30 that extends entirely through layer 14 and is offset to the side from openings 26, 28. A slot-like passage 32 connects openings 26 and 30, and a similar slot-like passage 34 connects openings 26 and 28. Preferably these passages extend entirely through the layer 14. Opening 30 comprises an internal vent chamber and provides a space for air from openings 26, 28 when the conductive areas 22, 24 are forced upwardly into openings 26, 28 as explained in more detail later. Passages 32, 34 provide pneumatic coupling between the vent chamber and the openings 26, 28.

Layer 16 is positioned directly over layer 14. Layer 16 has on its surface facing layer 14 a pattern of an electrical conductor which, when engaged by conductive areas 22, 24 on layer 12 will complete electrical circuits. More specifically, the pattern of electrical conductor on layer 16 is illustrated as comprising three spaced conductive lines 36, 38 and 40. A portion of line 36 is positioned over the opening 28 in layer 14 and conductive area 24 of layer 12. A portion of line 40 is positioned over opening 26 in layer 14 and the conductive area 22 in layer 12. Line 38 is common to both openings 26, 28, i.e. a portion of line 38 is positioned over both opening 26 and conductive area 22, and over opening 28 and conductive area 24. Thus, when conductive area 22 is flexed upwardly in the switch it can contact a portion of both lines 38 and 40 to complete an electrical circuit therebetween. Similarly, when conductive area 24 is flexed upwardly, it can contact a portion of conductive lines 36, 38 to complete an electrical circuit therebetween. Lines 36, 38 and 40 extend into a leg or handle portion 42 of layer 16 and terminate at three rigid electrical pin connections 44, 46 and 48, respectively. The pins can be plugged into a suitable receptacle for connecting the switch in an electrical circuit.

Layer 18 fits over layer 16. It has no conductive lines on it. Layer 18 closes and protects the top portion of the switch when it is mounted in apparatus as described below.

Figure 3:
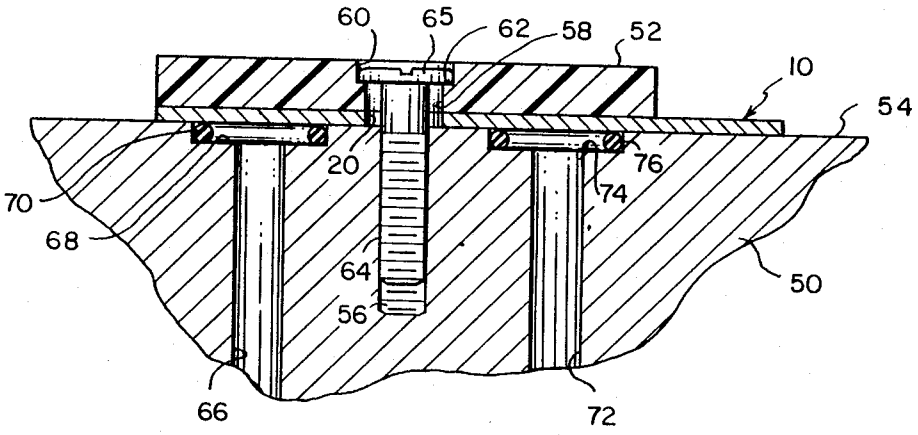
FIG. 3 is a fragmentary cross-section view showing the switch mounted in an apparatus, such as a water system, so that the fluid pressure of the system can operate the switch.

FIG. 3 of the drawings illustrates a typical installation of a switch 10 between a housing 50 and a backup plate 52. Housing 50 has a generally flat surface 54 with a threaded opening 56. Backup plate 52 also has a cylindrical hole 58 therein that is substantially the same diameter as the hole 20 in the switch. The upper end of hole 58 is enlarged as shown at 60 to form a shoulder 62. A mounting screw 64 has a threaded end that passes through the holes 58 and 20 in the plate 52 and switch 10, respectively, and is threaded into the hole 56 in the housing 50. Screw 64 also has a head 65 that is larger than hole 58 and engages the shoulder 62 to hold the backup plate and thus switch 10 firmly against the housing 50.

A passageway 66 in the housing 50 terminates at its upper end in an enlarged opening 68 at the surface 54 of the housing. An O-ring 70 is seated in the enlarged opening 68 around the passageway 60 and bears against the lower surface of switch 10 to seal the connection between the housing 50 and the switch 10. The opening 68 lies directly beneath the portion of layer 12 that contains the electrically conductive area 22.

Similarly, another passageway 72 in housing 50 terminates at its upper end in an enlarged opening 74 that is at the surface 54 of the housing. An O-ring 76 is seated in the opening 74 and bears against the lower surface of layer 12 of the switch to seal the connection therebetween. Opening 74 is located directly below the portion of layer 12 that contains the electrically conductive area 24.

In operation, passageways 66 and 72 are connected to two sources of fluid under pressure, such as water, in a drinking water system. Fluid can pass through passageways 66, 72 and enter the respective openings 68, 74 and into contact with the lower surface of layer 12 of the switch. Water will not damage the switch because the switch is made of a plastic material that is not adversely effected by exposure to water, and because there is nothing on the lower surface of the switch which would produce an electrical short or otherwise deteriorate operation of the switch. When the fluid in passageways 66, 72 reaches a predetermined high value, the fluid pressure acting on the lower surface of switch 10 moves the electrically conductive areas 22 or 24 on layer 12 upwardly into contact with the conductive lines 36, 38, 42 on layer 16, thereby closing the switch. More specifically, pressure in passageway 66 can effect closing of the switch to establish flow of electric current between conductive lines 38, 40, while pressure in passageway 72 can close an electric circuit between lines 36, 38.

Layers 12–18 are very thin. Thus there is very little space in openings 26, 28. When conductive areas 22, 24 are forced upwardly into the openings 26, 28, air within such openings would ordinarily be highly compressed since the conductive areas substantially fill the openings 26, 28. However, by virtue of the vent chamber 30 and its connection to openings 26, 28 by means of the slot-like passages 32, 34, the air forced out of openings 26, 28 by the conductive areas 22, 24 is allowed to vent into chamber 30. Moreover, if only conductive area 22 is moved into opening 26 while area 24 remains in its normal undeflected position as shown in FIG. 2, air in opening 26 also can be forced into opening 28 to thereby further provide venting and undesirable pressure build up in layer 14.

The vent chamber is completely within the switch. This internal venting is quite desirable and avoids the possibility of water or other fluids entering the switch through a vent hole extending outside the switch, such as disclosed in the beforementioned copending patent application. If no vent chamber is provided, it is possible that air under pressure in openings 26, 28 caused by closing of the switch could leak out of the switch, especially under sustained high pressure in passageways 66 and 72. This could produce a partial vacuum in openings 26, 28 when the pressure in passageways 66, 72 is relieved. Any such partial vacuum would create a condition which could hold the contacts closed after pressure was relieved in passageways 66 and 72.

The switch as described herein is responsive to pressure in two passageways 66, 72. However, by changing the electrically conductive patterns on the layers and the number of openings therebetween, one or more pair of switch contacts can be provided and used with one or more sources of fluid under pressure.

The various layers of the switch are bonded together with an adhesive. Preferably the adhesive used is a water system adhesive when the switch is to be used in a water-proof environment as described herein. The material used for forming the layers can be any suitable type, a polyester plastic having been found desirable for this use.

As mentioned earlier, the switch disclosed in the copening application can become distorted due to two O-rings of different sizes being on opposite sides of the switch. With the present design, only O-rings 70 and 76 on the lower side of the switch are needed in order to effect a satisfacfory seal. Thus the present invention eliminates the distortion problem which may occur with the earlier design. In addition, the backup plate for the switch disclosed in the beforementioned copending application requires grooves and other formations in it in order to accommodate O-rings. The backup plate 52 of the present invention is preferably flat, having a planar lower surface in contact with switch 10, thus reducing the cost and simplifying the manufacture of the backup plate. The present invention also eliminates domes and stainless steel strips disclosed in the prior application, and thus avoids potential problems associated therewith.

While the invention has been described in connection with a preferred embodiment thereof, it will understood that various modifications and changes can be effected within the spirit and scope of the appended claims.

I claim:

1. A switch adapted to be closed in response to pressure exerted on the switch, the switch comprising:

a plurality of thin layers of an electrically insulating material;

a first one of the layers having on a surface thereof an area of an electrically conductive material;

a second one of the layers in contact with the surface of the first layer, the second layer having an opening therethrough aligned with the area of conductive material on the first layer;

a third one of the layers, in contact with the second layer, the third layer having on a surface thereof, facing the second layer, an area of an electrically conductive material aligned with the opening in the second layer, the layers being sufficiently flexible to enable the areas of electrically conductive material to be brought into engagement by pressure exerted on the switch; and means communicating with the opening and defining an internal vent chamber for reducing air pressure build up in the opening when the areas of electrically conductive material are brought into contact, the vent chamber being fully enclosed within the layers and hermetically sealed from the environment external to the switch.

2. A switch as set forth in claim 1 wherein the vent chamber comprises an opening in one of the layers in spaced relation to the opening aligned with the areas of electrically conductive material, and a slot connecting the openings.

3. A switch as set forth in claim 2 wherein the slot is located in the second layer.

4. A fluid pressure switch assembly for closing an electrical circuit in response to a change in fluid pressure, the assembly comprising:

a housing having a generally flat surface, the housing having a passageway extending from the surface for connection to a source of fluid under pressure;

a back-up plate having a flat surface;

a flat pressure responsive switch sandwiched between the flat surfaces of the housing and the back-up plate, the switch having a first surface in engagement with the housing surface and over the passageway in the housing, the switch having electrical switch contacts therein that are opened and closed in response to changes in fluid pressure, the switch further containing an internal vent chamber fully enclosed within the switch and hermetically sealed from the environment external to the switch, said vent chamber serving to relieve pressure within the switch resulting from pressure exerted against the switch by fluid in the passageway;

a seal between the housing and the switch around the passageway to prevent leakage of fluid between the switch and housing; and means for holding the back-up plate, switch and housing together with the switch pressed against the seal and with the flat surface of the back-up plate opposite the seal to minimize deformation of the switch in the area of contact between the switch and the seal.

5. A switch adapted to be opened or closed in response to fluid pressure exerted against the switch, the switch comprising a first layer of a thin electrically insulating material having two spaced electrically conductive areas on an upper surface of the layer, a second layer of a thin electrically insulating material positioned over the first layer and in contact with the upper surface of the first layer, the second layer having three interconnected openings therethrough overlying the first layer with two of the openings being aligned with the electrically conductive areas on the upper surface, and a third layer of a thin electrically insulating material positioned over and in contact with the second layer, the third layer having on the surface thereof facing the second layer a pattern of an electrical conductor comprising three spaced conductive lines, and the third layer overlying all three openings in the second layer with (1) a first one of the conductive lines extending across said two openings in the second layer, (2) a second one of the conductive lines extending over one of said two openings, and (3) a third one of said conductive lines extending over the second one of said two openings, the layers being sufficiently flexible to enable the first layer to flex toward the third layer in response to a fluid pressure exerted against the bottom of the first layer in the area of the conductive areas on the upper surface of the first layer so that a predetermined value of fluid pressure can bring at least one of the conductive areas on the first layer into contact with two of the conductive lines on the third layer to complete an electrical circuit therebetween, and the layers being bonded together so that the three openings in the second layer are completely enclosed by the layers with the opening other than either of the said two openings, defining an enclosed internal vent chamber hermetically sealed from the environment external to the switch, said vent chamber serving to relieve pressure in the other two openings when the first layer is flexed toward the third layer to complete the electrical circuit.

* * * * *